US006007472A

United States Patent [19]

Schill et al.

[11] Patent Number: 6,007,472

[45] Date of Patent: Dec. 28, 1999

[54] VARIABLE VOLUME CELL SAVER BOWL

[75] Inventors: David M. Schill, Knoxville, Tenn.; Joseph G. Schill, Lynchburg, Va.

[73] Assignee: Schill Enterprises, Inc., Knoxville, Tenn.

[21] Appl. No.: 09/024,095

[22] Filed: Feb. 17, 1998

Related U.S. Application Data

[63] Continuation-in-part of application No. 08/708,830, Sep. 9, 1996, Pat. No. 5,728,040.

[51] Int. Cl.[6] ..... B04B 1/08

[52] U.S. Cl. ..... 494/41; 494/48; 494/67

[58] Field of Search ..... 494/41, 44, 47, 494/48, 56, 65, 67, 83, 84, 85

[56] References Cited

U.S. PATENT DOCUMENTS

| | | | |
|---|---|---|---|
| 260,412 | 7/1882 | Quimby . | |
| 3,930,609 | 1/1976 | Nelson . | |
| 4,530,691 | 7/1985 | Brown . | |
| 4,684,361 | 8/1987 | Feldman et al. | 494/41 |
| 4,943,273 | 7/1990 | Pages | 494/41 |
| 4,983,158 | 1/1991 | Headley | 494/41 |
| 5,100,372 | 3/1992 | Headley | 494/41 |
| 5,186,708 | 2/1993 | Stroucken et al. . | |
| 5,306,423 | 4/1994 | Hultsch . | |
| 5,405,308 | 4/1995 | Headley et al. . | |
| 5,441,475 | 8/1995 | Storruste et al. . | |
| 5,514,070 | 5/1996 | Pages | 494/41 |
| 5,728,040 | 3/1998 | Schill et al. | 494/48 |

*Primary Examiner*—Charles E. Cooley
*Attorney, Agent, or Firm*—Pitts & Brittian, P.C.

[57] ABSTRACT

A variable volume cell saver bowl to centrifuge blood for collection of red blood cells therefrom. The variable volume cell saver bowl is designed to vary the interior processing volume within the bowl to accommodate blood collections of various volumes in order to use the entire recovered volume of blood. The bowl includes generally an outer shell and an inner shell. The inner shell is disposed concentrically within the outer shell and defines a frusto-conical configuration similar to that of the outer shell first side wall. A piston head is secured to the inner shell lower end wall via at least one spacer. Rotation is imparted on the piston shaft or outer shell in order to rotate the bowl to create centrifugal force within the bowl. A linear displacement device is journalled to the distal end of the piston shaft in order to move the inner shell toward either the top or bottom end wall of the outer shell, thus reducing or increasing the interior processing volume within the bowl. In one embodiment of the bowl, the inner and outer shells are each configured with an upper end defining a cylindrical configuration. An upper seal is provided in this embodiment to prevent the collection of fluid within the upper end, thereby forcing substantially all of the blood to be processed into centrifugal separation.

6 Claims, 5 Drawing Sheets

VARIABLE VOLUME CELL SAVER BOWL

This continuation-in-part discloses and claims subject matter disclosed in our earlier filed pending application, Ser. No. 08/708,830, filed on Sep. 9, 1996 which issued as U.S. Letters Pat. No. 5,728,040 on Mar. 17, 1998.

TECHNICAL FIELD

This invention relates to the field of blood processing. More specifically, this invention relates to a variable volume cell saver bowl used in centrifugal processing of blood collected during a surgical procedure for re-introduction into the body from which it was collected

BACKGROUND ART

In the field of surgery, it is well known that blood is collected from a patient for various reasons. The blood that is collected is commonly centrifuged in order to separate the red blood cells from fluid in the blood, with the fluid being disposed. The final product of concentrated red blood cells is then re-introduced into the patient's blood system in order to thicken the blood. Specifically, the percentage of red blood cells in the blood, the hematocrit level, is increased.

Conventional collection bowls currently in use define a fixed volume. A typical collection bowl 10A is illustrated in FIG. 1. The bowl 10A includes an outer wall 14A and an inner wall 16A, with a particular volume defined therebetween and within which the blood is collected and centrifuged. Waste fluid is expelled and the red blood cells are kept within the volume. The inner wall 16A and outer wall 14A are fixed in relation to each other such that the volume within the bowl 10A is fixed. The inner wall 16A may be configured with a stepped frusto-conical shape as illustrated in broken lines, or with a frusto-conical shape as illustrated with solid lines. In either configuration, the volume within the bowl 10A is determined by the configuration and dimensions of the inner wall, and cannot be changed with the particular bowl 10A being used. Although various sizes may be chosen, the bowl 10A must be fill prior to re-introducing the red blood cells into the patient's blood system. Thus, if a surgical procedure is completed such that no more blood is to be collected, and if the collection bowl is not full, any red blood cells that have been collected are disposed. In another scenario, the red blood cells may be required during a surgical procedure, but not available because the collection bowl 10A is not yet full. In such an instance, the surgeon must wait until the appropriate amount of blood is collected such that it may be processed and the red blood cells harvested.

Other devices have been produced for separating components in a fluid using centrifugal separation. Typical of the art are those devices disclosed in the following U.S. Patents:

| Pat. No, | Inventor(s) | Issue Date |
|---|---|---|
| 260,412 | E. E. Quimby | July 4, 1882 |
| 3,930,609 | K. Nelson | Jan. 6, 1976 |
| 4,530,691 | R. I. Brown | July 23, 1985 |
| 5,186,708 | K. Stroucken, et al. | Feb. 16, 1993 |
| 5,306,423 | G. Hultsch | Apr. 26, 1994 |
| 5,405,308 | T. D. Headley, et al. | Apr. 11, 1995 |
| 5,441,475 | S. Storruste, et al. | Aug. 15, 1995 |

Of these devices, Quimby ('412) discloses a centrifugal separator for the separation of starch from liquid matter. The separator has a removable rim such that starch may be removed. Although the outer wall is movable with respect to the stripping disk, the volume within the separator, during operation, is not variable.

The device disclosed by Nelson ('609) is a centrifuge designed to prevent the admission of air into the bowl during discharge of sludge in order to maintain a normal liquid level. Nelson does not disclose a means for varying the volume defined within the centrifuge, regardless of whether or not it is in use.

Stroucken, et al. ('708), teach a centrifugal separator having a rotor body with a movable wall. The rotor of the '708 device includes two axially separated end walls and a surrounding wall disposed between, and separate from, the two end walls. The surrounding wall may be moved axially with respect to either or both end walls and is capable of elastic deformation in response to liquid pressure in the separation chamber. However, Stroucken, et al., do not teach a means for varying the volume within the separating chamber, especially to reduce the volume during operation of the same.

The device disclosed by Hultsch ('423) is a discontinuously operating filter centrifuge. The '423 device is constructed such that liquid is discharged from a filter cake, the filter cake being discharged from a filter bag when shifting out of the mouth of the drum, thus enabling the inspection of the interior of the drum. Hultsch, as in the above references, fails to teach a variable volume collection receptacle, and especially a receptacle whose volume may be reduced during operation of the centrifuge.

Headley, et al. ('308), disclose a disposable centrifuge rotor and core for blood processing whereby a plurality of projections extend into the processing region to minimize formation of fluid Coriolis waves. The '308 device is used in conjunction with a fixed volume centrifugal separator. Thus, Headley, et al., do not disclose a variable volume bowl.

The '475 device disclosed by Storruste, et al., includes a separation chamber housing split into what are described as mating, unhinged clamshell sections. Although the two sections are movable axially away from each other, such movement is provided for discharge of material from within the separation chamber. As with the previous devices, the '475 device does not provide for variance of the volume within the separation chamber, and especially does not allow for the volume within the chamber to be reduced during operation of the centrifuge.

The '691 device disclosed by Brown is a centrifuge having a movable mandrel for varying the volume within a blood processing chamber. The '691 device employs a chamber which, upon application of a force, conforms to the shape of a chamber cover and the mandrel. However, in the configuration disclosed by Brown, a volume of the blood being processed is necessarily situated in the center of the bowl, co-linear with or near the axis of rotation. Therefore, without some circulatory incentive, that blood will remain substantially unprocessed, as it is not being subjected to any centrifugal forces.

Therefore, it is an object of this invention to provide a means for varying the volume within the separation chamber of a centrifuge in order to accommodate variations in the volume of fluid collected such that, in the instance of collected blood, the desired component may be removed from the fluid and used as needed.

It is a further object of the present invention to provide a variable volume cell saver bowl for use in collecting red blood cells from blood collected during surgery for re-introduction into the patient in order to elevate the hematocrit level of the patient, the bowl volume being adjustable during operation of the device to accommodate various volumes of blood collected.

As a result, it is a further object of the present invention whereby the volume within the separation chamber may be reduced such that lower volumes of blood collected may be immediately centrifuged to collect whatever red blood cells are present.

Still another object of the present invention is to provide a variable volume cell saver bowl which defines an interior processing volume configured to displace the blood to be processed away from an axis of rotation of the bowl, thereby insuring proper processing of substantially the entire volume of blood introduced therein.

DISCLOSURE OF THE INVENTION

Other objects and advantages will be accomplished by the present invention which serves to centrifuge blood for collection of red blood cells therefrom. The variable volume cell saver bowl is designed to vary the volume within the bowl to accommodate blood collections of various volumes in order to use the entire recovered volume of blood, thereby reducing the amount of wasted blood. The bowl is used in certain circumstances to reduce the volume within the bowl in order to immediately recover red blood cells and re-introduce the same into the patient in order to raise the hematocrit level and increase the likelihood of success of the operation being performed on the patient.

The bowl includes generally an outer shell and an inner shell. The outer shell defines a first side wall having a frusto-conical configuration and a second side wall having a cylindrical configuration, the larger diameter of the first side wall having the same cross-section of the second side wall. The first side wall is sloped at an angle θ with respect to the central axis of the bowl. The outer shell first and second side walls are integrally formed. Upper and lower end walls are provided for closing the upper end of the outer shell first side wall and the lower end of the outer shell second side wall, respectively.

The inner shell is disposed concentrically within the outer shell and defines a frusto-conical configuration sloped at the angle θ with respect to the central axis of the bowl. A centrally disposed hollow core is carried within the inner shell such that the inner shell defines a substantially toroidal configuration having a trapezoidal cross-section.

In an alternate embodiment of the bowl of the present invention, the inner and outer shells are each configured with an upper end defining a cylindrical configuration. An upper seal is provided to prevent the collection of fluid within the upper end, thereby forcing substantially all of the blood to be processed into centrifugal separation.

An inlet/outlet coupling is carried by the outer shell upper end wall through an opening defined thereby. In order to allow rotation of the bowl about its longitudinal axis, the outer shell is secured to the inlet/outlet coupling using a bearing, seal, or other such device. The inlet portion of the coupling is directed through the hollow core of the inner shell and eventually to the upper end of the outer shell and through the outlet side of the coupling.

In order to centrifuge the blood, the bowl is rotated about its central axis. The inlet/outlet coupling is stationary with respect to the bowl, as a result of the bearing provided between the upper end wall of the outer shell and the inlet/outlet coupling. A piston is secured to the inner shell and a rotation imparting force is applied to the piston. A piston head is secured to the inner shell lower end wall via at least one spacer. Each spacer is secured at one end to the piston head and at the other end to the inner shell lower end wall such that the inner shell is fixed in relation to the piston. The piston head is configured to be closely received within the second side wall of the outer shell. A seal is carried by the piston head and is interposed between the piston head and the outer shell second side wall. The piston includes a shaft carried by the piston head and received through an opening defined by the outer shell lower end wall. A conventional rotation imparting device is used to impart rotation on the piston shaft, and thus the piston head, the inner shell and the outer shell. In an alternate embodiment, the rotation imparting device may impart rotation directly on the outer shell, thus likewise rotating the piston and the inner shell.

In order to accommodate for variation in volumes during operation of the bowl, the bowl of the present invention is provided with a linear displacement device. The linear displacement device is journalled to the distal end of the piston shaft using a conventional bearing such that the piston shaft may rotate while the linear displacement device remains relatively still. The linear displacement device includes a rack and pinion device whereby as a crank is turned, the rack portion of the linear displacement device is moved linearly, thus moving the inner shell toward either the top or bottom end wall of the outer shell, thus reducing or increasing the volume within the bowl.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A variable volume cell saver bowl incorporating various features of the present invention is illustrated generally at 10 in the figures. The variable volume cell saver bowl, or bowl 10, is designed for centrifuging blood for collection of red blood cells therefrom. Moreover, in the preferred embodiment the bowl 10 is designed to vary the interior processing volume 100 within the bowl 10 to accommodate blood collections of various volumes in order to use substantially the entire recovered volume of blood, thereby reducing the amount of wasted blood. In certain circumstances, the ability to reduce the interior processing volume 100 within the bowl 10 in order to immediately recover red blood cells and re-introduce the same into the patient in order to raise the hematocrit level will increase the likelihood of success of the operation being performed on the patient. In one embodiment of the bowl 10', an interior processing volume 100' is configured to displace the blood to be processed away from an axis of rotation of the bowl 10', thereby ensuring proper processing of substantially the entire volume of blood introduced therein.

Figure 1:
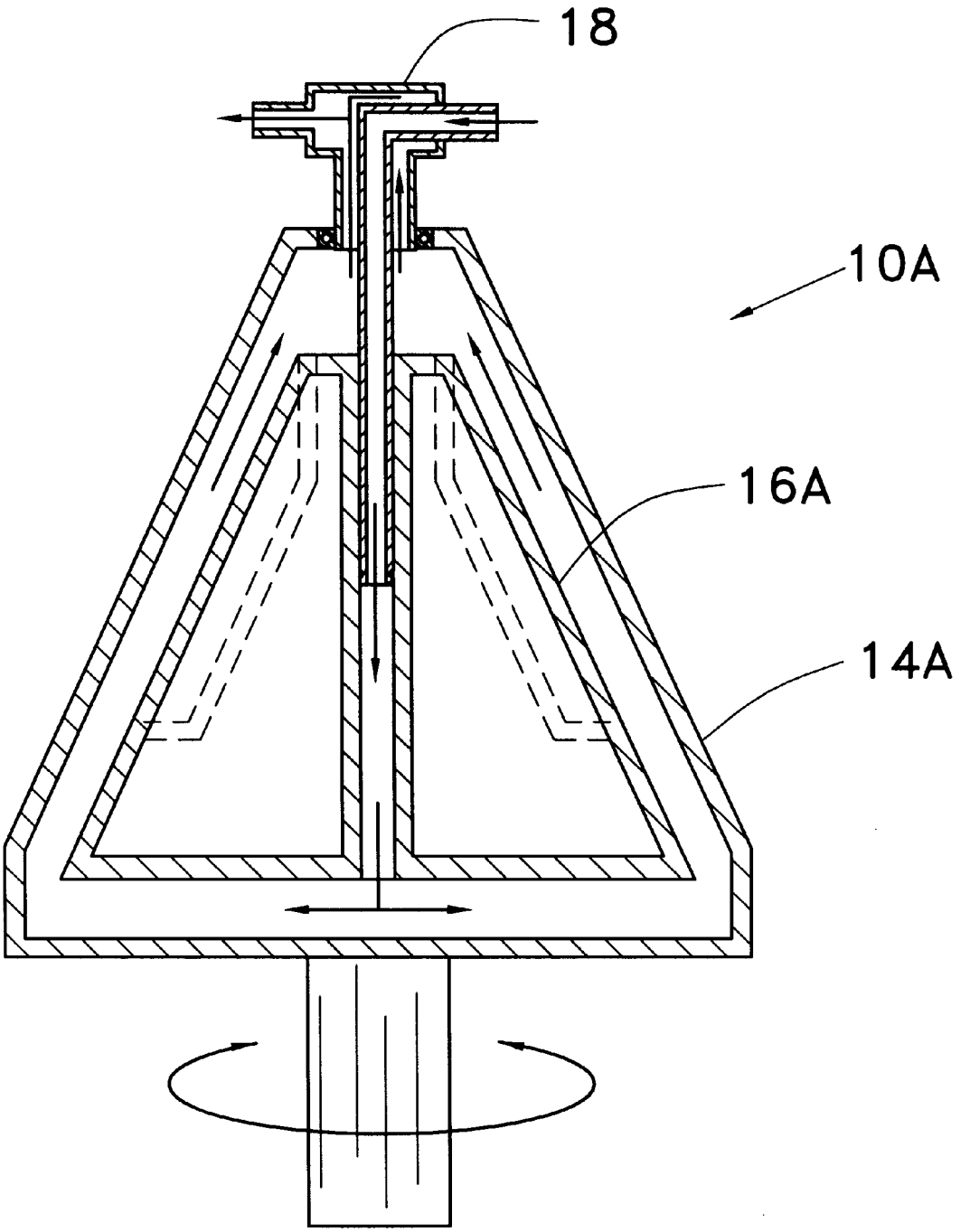
Fig. 1 (PRIOR ART)
FIG. 1 is an elevation view, in section, of a conventional centrifugal separator having a replaceable bowl.
Figure 2:
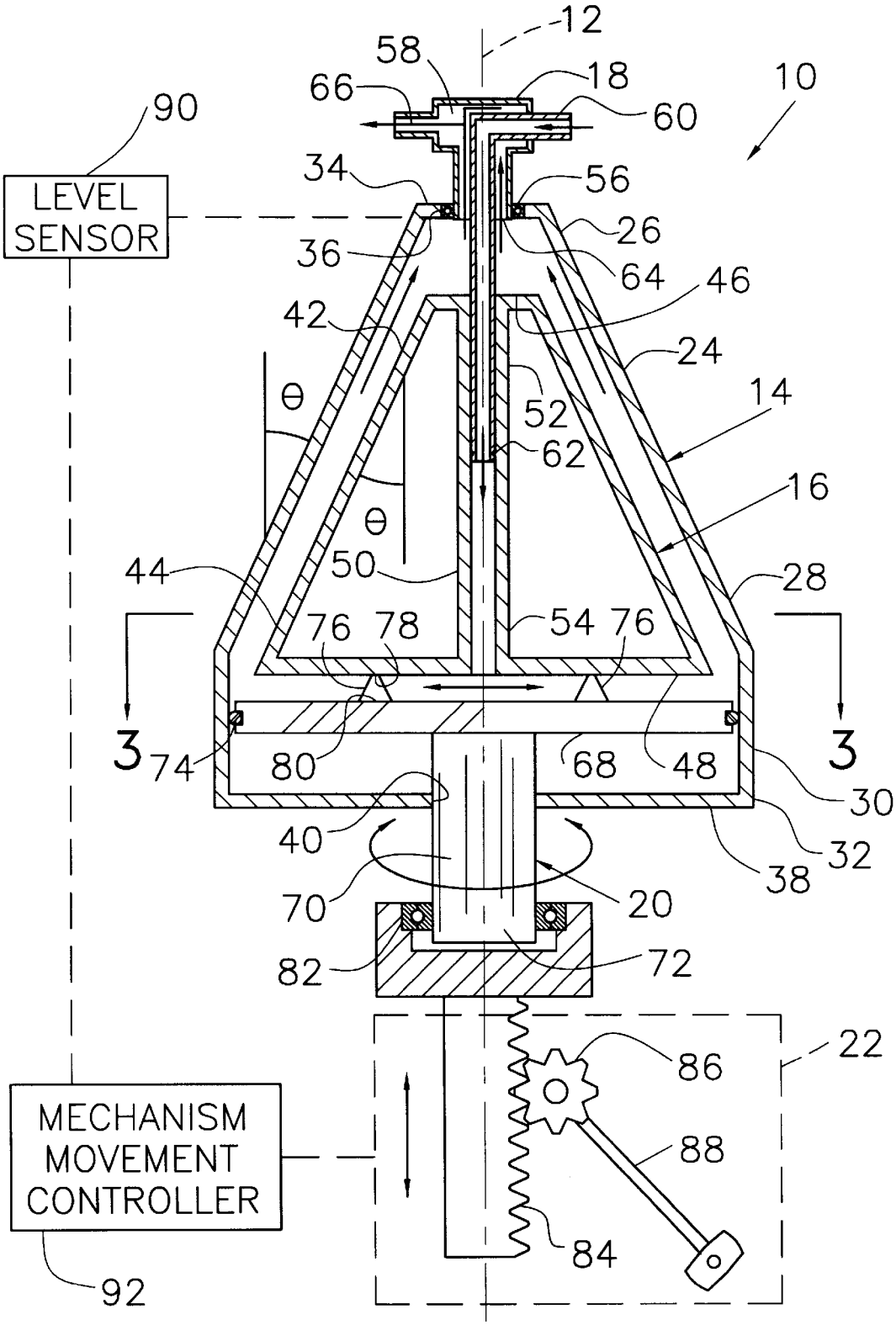
FIG. 2 is an elevation view, in section, of the variable volume cell saver bowl constructed in accordance with several features of the present invention.

As illustrated in FIG. 2, the bowl 10 of the present invention is comprised generally of an outer shell 14 and an inner shell 16. The outer shell 14 defines first and second side walls 24,30. The first side wall 24 defines a frusto-conical configuration terminating at an upper end 26 having a first inside diameter and at a lower end 28 having a second, larger inside diameter. The outer shell first side wall 24 is sloped at an angle θ with respect to the central axis 12 of the bowl 10. The outer shell second side wall 30 defines a cylindrical configuration having the second inside diameter defined by the lower end 28 of the outer shell first side wall 24. To this extent, the outer shell second side wall 30 is secured to the outer shell first side wall 24 at the lower end 28 thereof. Preferably, the outer shell first and second side walls 24,30 are integrally formed. Upper and lower end walls 34,38 are provided for closing the upper end 26 of the outer shell first side wall 24 and the lower end 32 of the outer shell second side wall 30, respectively.

The inner shell 16 is disposed concentrically within the outer shell 14 and includes a side wall 41 which defines a frusto-conical configuration sloped at the angle θ with respect to the central axis 12 of the bowl 10. The upper end 42 of the inner shell 16 defines an outside diameter substantially equal to the first inside diameter of the outer shell first side wall 24. The lower end 44 of the inner shell side wall 41 defines an outside diameter larger than the first inside diameter but smaller than the second inside diameter defined by the outer shell first side wall 24. Thus, the inner shell side wall 41 is shorter than the first side wall 24 of the outer shell 14 when measured along the central axis 12 of the bowl 10. Upper and lower end walls 46,48 are provided for closing the upper and lower ends 42,44 of the inner shell side wall 41, respectively. A hollow core 50 is carried within the inner shell 16 between the upper and lower ends 42,44 thereof. In the preferred embodiment, the core 50 opens at a proximal end 52 on the upper end wall 46 and at a distal end 54 on the lower end wall 48 of the inner shell 16. The core 50 is concentrically disposed within the inner shell 16 such that the inner shell 16 and core 50 form a substantially toroidal configuration having a trapezoidal cross-section.

The outer shell upper end wall 34 defines an opening 36 for receiving an inlet/outlet coupling 18. In order to allow rotation of the bowl 10 about its central axis 12, the outer shell 14 is secured to the inlet/outlet coupling 18 using a bearing 56, seal (not shown), or other such device. The coupling 18 defines an inner volume 58 through which waste fluid is evacuated. Received through the inner volume 58 is an inlet tube 60 for communicating blood from a blood source (not shown) through the inlet/outlet coupling 18 to the core 50 of the inner shell 16. The inlet tube 60 exits the coupling 18 at a point coincident with the central axis 12 of the bowl 10 and extends into the core 50 of the inner shell 16. A seal 62 is provided between the inlet tube 60 and the inner shell core 50 in order to prevent blood from seeping therebetween.

The outlet portion of the coupling 18 defines a mouth 64 having an annular opening around and concentric with the inlet tube 60 extending into the bowl 10. An outlet 66 is defined by the coupling 18 for evacuation of the waste fluid. Thus, as blood is introduced through the inlet tube 60, it is passed through the inner shell core 50 to the interior processing volume 100 defined between the inner and outer shells 16,14. The red blood cells are centrifuged out of the blood and the remaining fluid is evacuated through the outlet 66 of the inlet/outlet coupling 18.

Figure 3:
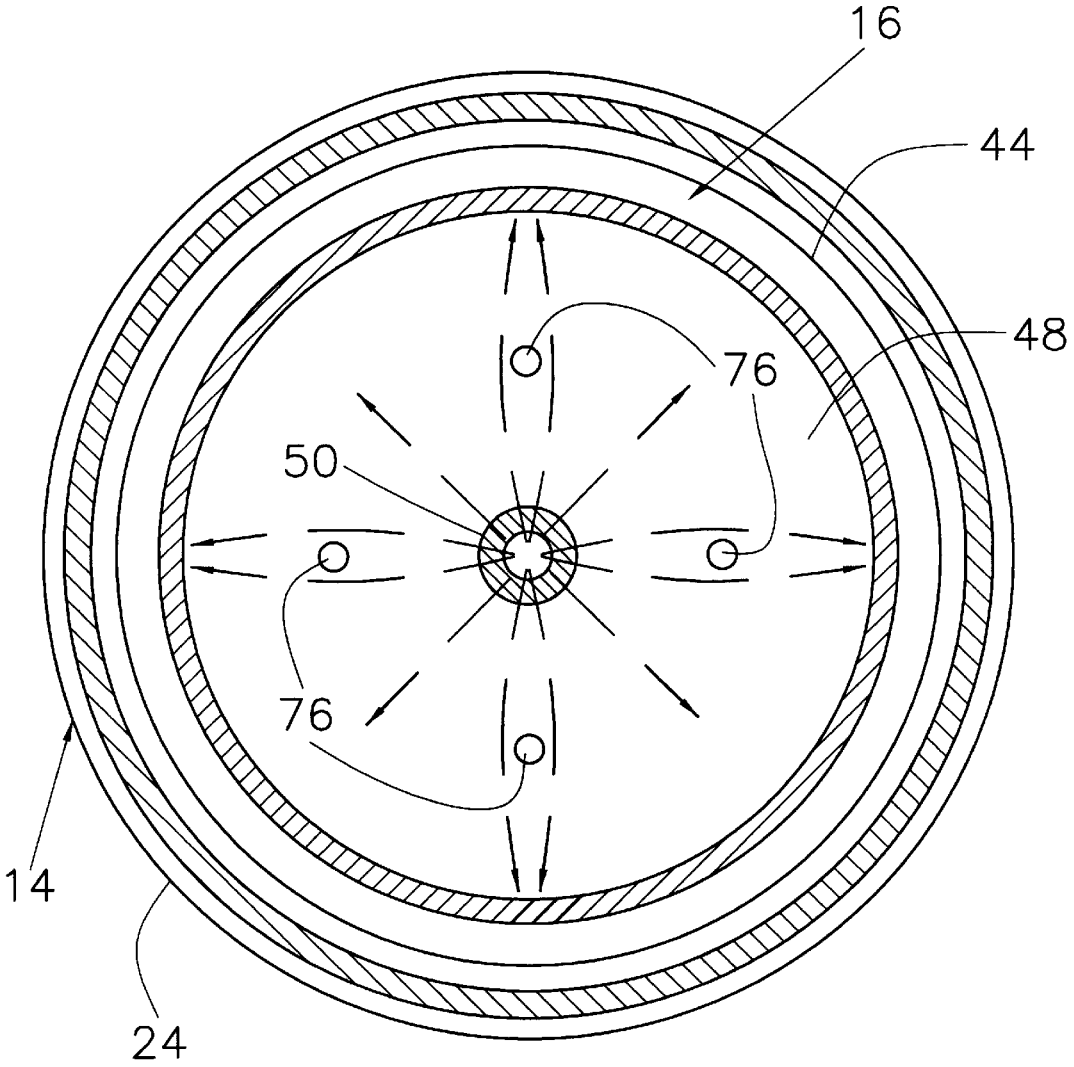
FIG. 3 is a plan view, in section, of the variable volume cell saver bowl taken at 3—3 of FIG. 2.

In order to centrifuge the blood, the bowl 10 is rotated about its central axis 12. The inlet/outlet coupling 18 is stationary with respect to the bowl 10, as a result of the bearing 56 provided between the upper end wall 34 of the outer shell 14 and the inlet/outlet coupling 18. In order to accomplish rotation of the bowl 10, a piston 20 is secured to the inner shell 16 and a rotation imparting force is applied to the piston or the outer shell 14. To this extent, a piston head 68 is secured to the inner shell lower end wall 48 via at least one spacer 76. Each spacer 76 is secured at one end 80 to the piston head 68 and at the other end 78 to the inner shell lower end wall 48 such that the inner shell 16 is fixed in relation to the piston 20. FIG. 3 is an illustration of the relative spacing of four spacers 76. The piston head 68 is configured to be closely received within the second side wall 30 of the outer shell 14. A seal 74 is carried by the piston head 68 and is interposed between the piston head 68 and the outer shell second side wall 30. The piston 20 includes a shaft 70 carried by the piston head 68 and received through an opening 40 defined by the outer shell lower end wall 38. In order to impart rotation on the outer shell 14, the piston shaft 70 and the opening 40 may be keyed, may define a non-circular cross-section, or may be otherwise configured to prohibit rotation of the outer shell 14 with respect to the piston shaft 70, while allowing axial movement of one with respect to the other. A conventional rotation imparting device (not shown) is used to impart rotation on the piston shaft 70, and thus the piston head 68, the inner shell 16 and the outer shell 14. The rotation imparting device is used to create centrifugal forces within the bowl 10, thus causing the components of the blood to separate.

Figure 4:
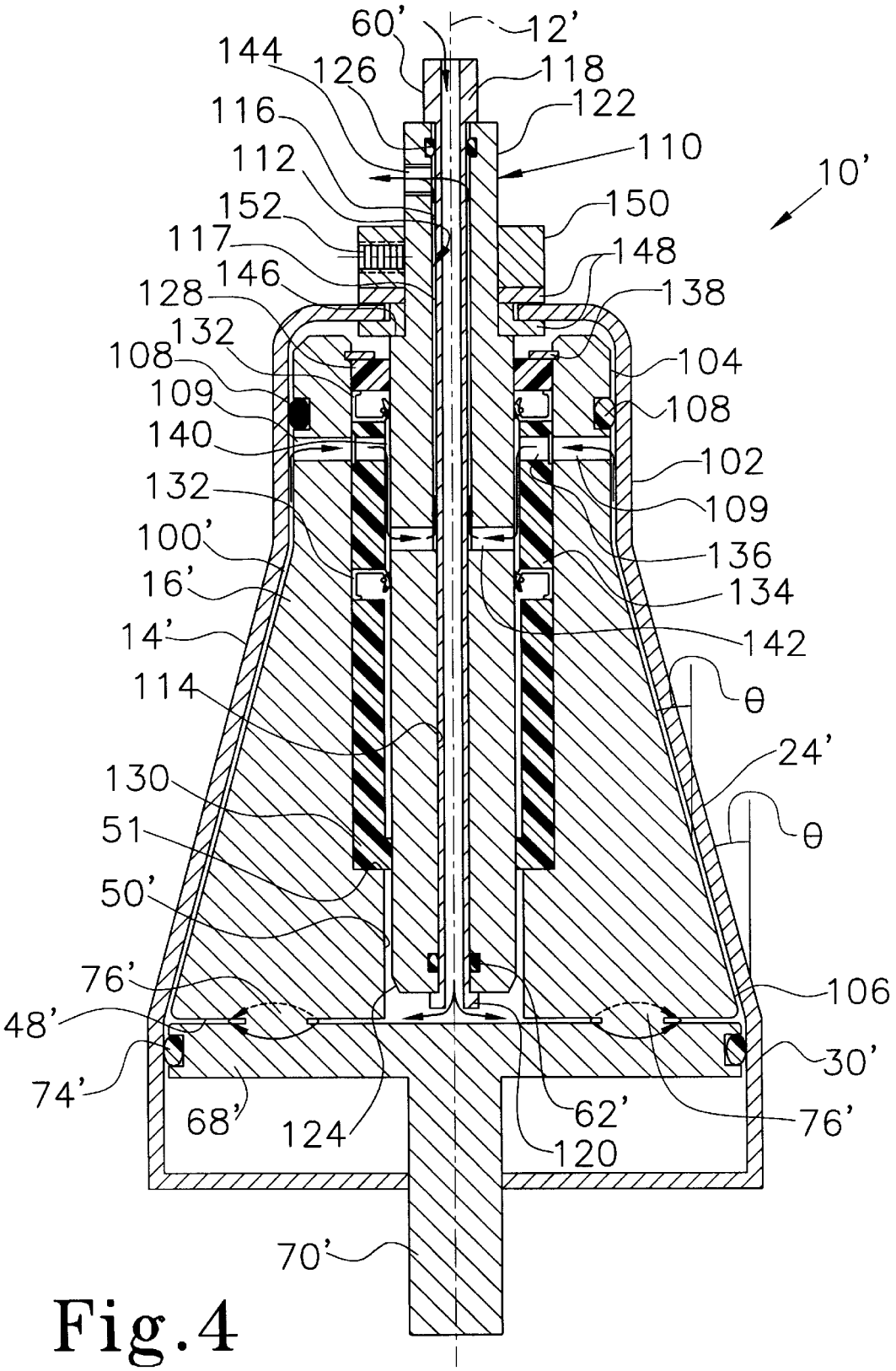
FIG. 4 is an elevation view, in section, of an alternate embodiment of the variable volume cell saver bowl, with the inner shell being positioned at the top of its travel within the outer shell in order to minimize the interior processing volume.
Figure 5:
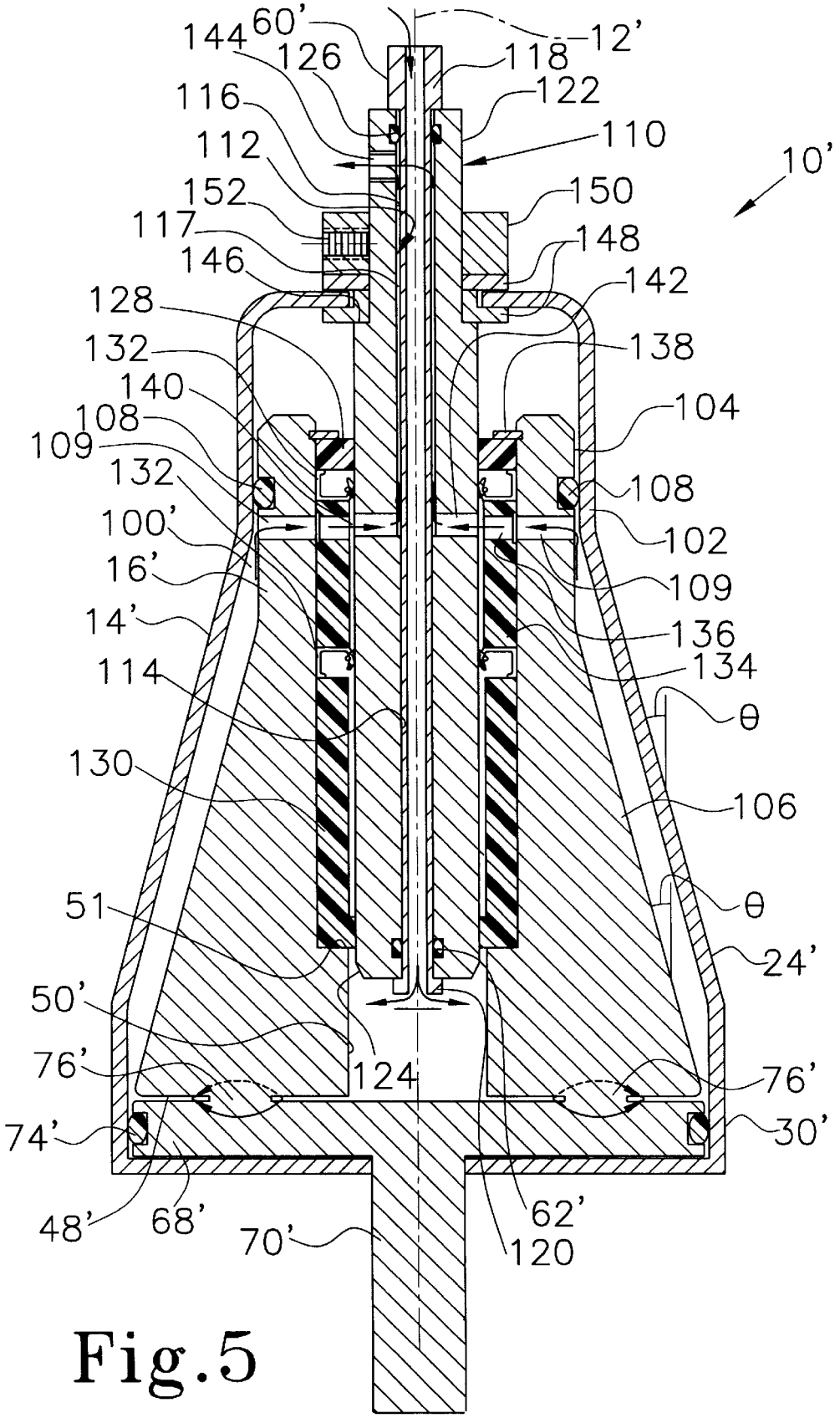
FIG. 5 is an elevation view, in section, of the embodiment of the variable volume cell saver bowl of FIG. 4, with the inner shell being positioned at the bottom of its travel within the outer shell in order to maximize the interior processing volume.

Illustrated in FIGS. 4 and 5 is an alternate embodiment of the bowl 10' of the present invention, wherein like numerals are labelled with like numeric identifiers followed by a "'". In this embodiment, the interior processing volume 100' defined between the outer shell 14' and the inner shell 16' is configured such that blood introduced therein to be processed is displaced away from the central axis 12', thereby ensuring proper processing of substantially the entire volume of blood introduced therein. FIG. 4 illustrates the inner shell 16' being positioned at the top of its travel within the outer shell 14' in order to minimize the interior processing volume 100', while FIG. 5 illustrates the inner shell 16' being positioned at the bottom of its travel within the outer shell 14' in order to maximize the interior processing volume 100'.

As illustrated in FIGS. 4 and 5, the outer shell 14' defines upper, intermediate, and lower side walls 102,24',30'. The intermediate and lower side walls 24',30' are substantially similar in configuration to the first and second side walls 24,30, respectively, of the previously described embodiment. The upper side wall 102 defines a cylindrical configuration having a length substantially equal to the length of the lower side wall 30', which is at least the length of travel of the inner shell 16' within the outer shell 14'. Other features of the outer shell 14' are similar to the outer shell 14 described in the previous embodiment.

The inner shell 16' is disposed concentrically within the outer shell 14'. The inner shell 16' is defined by an upper side wall 104 and a lower side wall 106. The lower side wall 106 is substantially similar to the side wall 41 of the previously described embodiment. The upper side wall 104 defines a cylindrical configuration dimensioned to be received within the upper wall 102 of the outer shell 14'. As in the previous embodiment, the inner shell 16' is mounted on the piston head 68' via at least one spacer 76' extending between the piston head 68' and the inner shell lower end wall 48'.

A first seal 74' is carried by the piston head 68' and is interposed between the piston head 68' and the outer shell lower side wall 30'. A second seal 108 is carried by the inner shell upper side wall 104 and is interposed between the inner shell upper side wall 104 and the outer shell upper side wall 102. Thus, the interior processing volume 100' is defined as the volume between the first and second seals 74',108 and the outer and inner shells 14',16'. As illustrated in FIG. 4, the interior processing volume 100' may be minimized by moving the inner shell 16' up to its limit of travel within the outer shell 14'. Conversely, as illustrated in FIG. 5, the interior processing volume 100' may be maximized by moving the inner shell 16' down to its limit of travel within the outer shell 14'.

The inner shell 16' defines a hollow core 50' along the central axis 12'. At least one through opening 109 is defined in the inner shell upper side wall 104 proximate and below the second seal 108 in order to establish fluid communication from the interior processing volume 100' to the hollow core 50'. A shaft 110 is received within the core 50'. The shaft 110 defines a hollow core 112 which defines a first diameter in a lower portion 114 defined from a lower end to approximately a midpoint thereof, and a second, slightly larger, second diameter in an upper portion 116 defined from the approximate midpoint to the upper end thereof A hollow blood inlet tube 60' is disposed within the shaft hollow core 112. The blood inlet tube 60' defines an upper flange 118 configured to engage the upper end 122 of the shaft 110 and a lower flange 120 configured to engage the lower end 124 of the shaft 110. Thus, the upper and lower flanges 118,120 serve to secure the blood inlet tube 60' within the shaft 110. The blood inlet tube 60' is configured to be closely received within the lower portion of the shaft hollow core 112, while defining an annular space 117 between the blood inlet tube 60' and the upper portion 116 of the shaft hollow core 112. In order to ensure that leakage does not occur between the shaft 110 and the blood inlet tube 60', seals 62',126 are provided at the lower and upper ends, respectively, of the blood inlet tube 60', and are each configured to engage an inner surface of the shaft hollow core 112.

The position of the shaft 110 with respect to the inner shell hollow core 50' is maintained using at least one alignment bearing. Illustrated is an upper alignment bearing 128 and a lower alignment bearing 130. The upper alignment bearing 128 is disposed at a location above the inner shell through opening 109 in order to maintain fluid communication between the interior processing volume 100' and the inner shell hollow core 50'. The lower alignment bearing 130 is seated within the inner shell hollow core 50' on a shoulder 51 defined therein. It will be seen at this point that fluid communication has been established from a fluid source (not shown), into and through the blood inlet tube 60', between the lower end of the shaft 110 and the inner shell hollow core 50' up to the lower alignment bearing 130, and then between the inner shell 16' and the piston head 68', around the spacers 76' and into the interior processing volume 100'. From the interior processing volume 100', fluid communication continues through the inner shell through opening 109 to the inner shell hollow core 50', between the upper and lower alignment bearings 128,130. In order to prevent fluid from seeping between the upper and lower alignment bearings 128,130 and either the inner shell hollow core 50'or the shaft 110, seals 132 are disposed immediately below the upper alignment bearing 128 and immediately above the lower alignment bearing 130. A spacer 134 defining a through opening 136 is disposed between the two seals 132 in order to maintain the relative positions of the upper and lower alignment bearings 128,130 and the seals 132. In order to maintain the position of each of these components within the inner shell hollow core 50', a retaining ring 138 is provided above the upper alignment bearing 128. The spacer through opening 136 is defined in the spacer 134 at a location in alignment with the inner shell through opening 109 in order to maintain fluid communication from the interior processing volume 100' to the shaft 110.

The spacer 134 defines an interior diameter larger than the outside diameter of the shaft 110 such that an annular space 140 is defined therebetween and between the two seals 132. An inlet 142 is defined by the shaft 110 proximate the lower end of the upper portion 116 thereof The inlet 142 is further disposed such that fluid communication is established from the interior processing volume 100', through the inner shell through opening 109, through the spacer through opening 136, through the annular space 140, and finally through the inlet 142 to the annular space 117 defined between the shaft hollow core upper portion 116 and the blood inlet tube 60'. It will be seen, then, that the height of the spacer 134, or the distance between the seals 132, must be at least equal to the length of travel of the inner shell 16' within the outer shell 14'. An outlet 144 is defined at the upper end of the shaft 110 in order to finally establish fluid communication to an external collection and/or disposal source (not shown).

The upper end of the shaft 110 defines a shoulder 146 upon which is disposed a shield 148. The shield 148 is provided for the inlet and outlet of air from within a volume defined between the inner and outer shells 16',14' and above the second seal 108 as the inner shell 16' is moved up or down within the outer shell 14'. The shield 148 may also serve as a bearing.

A collar 150 is provided above the shield 148 on the shaft 110 for maintaining the position of the shaft 110 with respect to the outer shell 14'. The collar 150 is secured to the shaft 110 using a conventional fastener such as a set screw 152.

In the embodiment illustrated in FIGS. 4 and 5, it will be seen that, because the interior processing volume 100' is limited to that volume defined between the inner and outer shells 16',14' and between the first and second seals 74',108, the entire volume of blood to be processed is forced into centrifugal separation, thereby eliminating the collection of unprocessed blood proximate the central axis 12' of the bowl 10'.

In order to accommodate for variation in volumes during operation of the bowl 10, the bowl 10 of the present invention is provided with a linear displacement device 22. The linear displacement device 22 is journalled to the distal end 72 of the piston shaft 70 using a conventional bearing 82 such that the piston shaft 70 may rotate while the linear displacement device 22 remains relatively still. In the illustrated embodiment, the linear displacement device 22 includes a rack 84 and pinion 86 device whereby as a crank 88 is turned, whether electrically or mechanically, automatically or manually, the rack 84 portion of the linear displacement device 22 is moved linearly, thus moving the inner shell 16 toward either the upper or lower end wall 34,38 of the outer shell 14, thus reducing or increasing the interior processing volume 100 within the bowl 10. Although a rack 84 and pinion 86 device is illustrated, it will be understood that any conventional linear displacement 22 device may be used to control the interior processing volume 100 within the bowl 10.

Thus, when it is necessary to reduce the interior processing volume 100 within the bowl 10, the inner shell 16 is moved toward the upper end wall 34 of the outer shell 14. Similarly, when the interior processing volume 100 within the bowl 10 needs to be increased, the linear displacement device 22 is operated to move the inner shell 16 toward the lower end wall 38 of the outer shell 14.

As indicated with broken lines in FIG. 2, a level sensor 90 may be provided for sensing when the interior processing volume 100 within the bowl 10 is filled with red blood cells. The level sensor 90 is of a conventional type such as an infrared detector, a light beam, or otherwise, and is disposed proximate the upper end 26 of the outer shell first end wall 24. Such a level sensor 90 may be used as a result of the separation of the red blood cells from the fluid in the blood. The fluid is clear, therefore allowing detection between the two components. Further, in order to assist in accomplishing detection of a filled bowl 10, the outer shell 14 is fabricated from a transparent material. When the level sensor 90 detects that the bowl has been filled with red blood cells, a mechanism movement controller 92 serves to cease introduction of blood into the bowl 10, and further to halt operation of the linear displacement device 22. In the instance where the linear displacement device 22 is not being operated, but where the level of red blood cells has reached its limit, the linear displacement device 22 may be activated to increase the interior processing volume 100 within the bowl 10, or the introduction of blood into the bowl 10 may be ceased. When such has been ceased, the red blood cells may be removed from the bowl 10 and re-introduced into the blood system of the patient.

From the foregoing description, it will be recognized by those skilled in the art that a variable volume cell saver bowl offering advantages over the prior art has been provided. Specifically, the variable volume cell saver bowl provides a means whereby the volume within the bowl may be varied during operation of the bowl. In particular, the volume within the bowl may be reduced during operation in order to accommodate smaller volumes of collected blood such that the red blood cells may be centrifuged out of the remaining fluid in order for the red blood cells to be re-introduced into the blood system from which they were recovered. Thus, the hematocrit level may be raised when required without the need for waiting for the bowl to be filled. Further, when no more blood is to be collected, the blood within the bowl may be centrifuged and the red blood cells used, as opposed to the entire blood collection being disposed as required in prior art devices.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A variable volume cell saver bowl for use in centrifuging red blood cells from a collection of blood, said variable volume cell saver bowl being used in conjunction with a conventional inlet/outlet coupling and a conventional rotation imparting device, the inlet/outlet coupling having a housing through which passes a centrally disposed blood inlet and an annular waste fluid outlet disposed about the blood inlet, the blood inlet extending from the housing at a first end thereof, said variable volume cell saver bowl comprising:

an outer shell having a side wall, an upper end wall, and a lower end wall, said side wall defining an upper side wall, an intermediate side wall, and a lower side wall, said upper side wall terminating at an upper end and said lower side wall terminating at a lower end, said upper end wall being configured to substantially cover said upper end and said lower end wall being configured to substantially cover said lower end, said upper end wall defining a first opening for receiving the inlet/outlet coupling, said upper side wall and said lower side wall each defining a cylindrical configuration and each defining a first length;

an inner shell disposed concentrically within said outer shell and defining a substantially similar configuration as at least a portion of said outer shell side wall, said inner shell being movable a distance equal to said first length along a central axis defined by said outer shell in order to vary a volume defined between said outer shell and said inner shell, said inner shell defining an upper side wall and a lower side wall, said upper side wall being configured to be received within said outer shell upper side wall and extend to said outer shell upper end wall, said lower side wall being configured to be received within and substantially conform to an interior of said outer shell intermediate side wall;

a linear displacement device for moving said inner shell within said outer shell along said outer shell central axis, said linear displacement device including a piston having a piston head and a piston shaft, said inner shell being carried by said piston head, said piston head being configured to be received within said outer shell lower side wall;

at least one spacer secured between said piston head and an inner shell lower end wall;

an upper seal disposed between said inner shell upper side wall and said outer shell upper side wall to prevent fluid communication therebetween; and a lower seal disposed between said piston head and said outer shell lower side wall to prevent fluid communication therebetween, said upper seal, said lower seal, said inner shell, said outer shell and said piston head cooperating to define an interior processing volume, said interior processing volume being substantially disposed away from said central axis, thereby forcing blood introduced therein to be subjected to centrifugal separation.

2. The variable volume cell saver bowl of claim 1 wherein said outer shell intermediate side wall defines a frusto-conical configuration having a first inside diameter at an upper end and a second inside diameter at a lower end, said outer shell intermediate side wall defining a slope of angle θ with respect to said outer shell central axis, said outer shell upper side wall defining said first inside diameter and extending from said outer shell intermediate side wall upper end, said outer shell lower side wall defining said second inside diameter and extending from said outer shell intermediate side wall lower end.

3. The variable volume cell saver bowl of claim 2 wherein said inner shell lower side wall defines a frusto-conical configuration with a slope of said angle θ with respect to said outer shell central axis, said inner shell further including a hollow core having a proximal end opening on an inner shell upper end wall and a distal end opening on said inner shell lower end wall, said inner shell thus defining a toroidal configuration having a trapezoidal cross-section.

4. The variable volume cell saver bowl of claim 2 further comprising a shield disposed between said outer shell upper end wall first opening and the inlet/outlet coupling, said shield allowing air to be introduced into and evacuated from within a volume defined between said outer shell and said inner shell and above said upper seal.

5. The variable volume cell saver bowl of claim 1 wherein said piston shaft is secured at a proximal end to said piston head and extends through a second opening defined by said outer shell lower end wall and coaxially with said outer shell central axis, said linear displacement device further including a reciprocating shaft coupled to said piston shaft via a bearing, said reciprocating shaft carrying a rack portion of a rack and pinion gear, a pinion portion being disposed to cooperate with said rack portion when said pinion portion is rotated, said linear displacement device further including a crank for turning said pinion portion of said rack and pinion gear.

6. A variable volume cell saver bowl for use in centrifuging red blood cells from a collection of blood, said variable volume cell saver bowl being used in conjunction with a conventional inlet/outlet coupling and a conventional rotation imparting device, the inlet/outlet coupling having a housing through which passes a centrally disposed blood inlet and an annular waste fluid outlet disposed about the blood inlet, the blood inlet extending from the housing at a first end thereof, said variable volume cell saver bowl comprising:

an outer shell having a side wall, an upper end wall, and a lower end wall, said side wall defining an upper side wall, an intermediate side wall, and a lower side wall, said upper side wall terminating at an upper end and said lower side wall terminating at a lower end, said upper end wall being configured to substantially cover said upper end and said lower end wall being configured to substantially cover said lower end, said upper end wall defining a first opening for receiving the inlet/outlet coupling, said upper side wall and said lower side wall each defining a cylindrical configuration and each defining a first length, said outer shell intermediate side wall defining a frusto-conical configuration having a first inside diameter at an upper end and a second inside diameter at a lower end, said intermediate side wall defining a slope of angle θ with respect to a central axis defined by said outer shell, said upper side wall defining said first inside diameter and extending from said intermediate side wall upper end, said lower side wall defining said second inside diameter and extending from said intermediate side wall lower end;

an inner shell disposed concentrically within said outer shell and defining a substantially similar configuration as at least a portion of said outer shell side wall, said inner shell being movable a distance equal to said first length along said outer shell central axis in order to vary a volume defined between said outer shell and said inner shell, said inner shell defining an upper side wall and a lower side wall, said upper side wall being configured to be received within said outer shell upper side wall and extend to said outer shell upper end wall, said lower side wall being configured to be received within and substantially conform to an interior of said outer shell intermediate side wall, said inner shell lower side wall defining a frusto-conical configuration with a slope of said angle θ with respect to said outer shell central axis, said inner shell further including a hollow core having a proximal end opening on an inner shell upper end wall and a distal end opening on said inner shell lower end wall, said inner shell thus defining a toroidal configuration having a trapezoidal cross-section;

a linear displacement device for moving said inner shell within said outer shell along said outer shell central axis, said linear displacement device including a piston having a piston head and a piston shaft, said inner shell being carried by said piston head, said piston head being configured to be received within said outer shell lower side wall, said piston shaft being secured at a proximal end to said piston head and extending through a second opening defined by said outer shell lower end wall and coaxially with said outer shell central axis, said linear displacement device further including a reciprocating shaft coupled to said piston shaft via a bearing, said reciprocating shaft carrying a rack portion of a rack and pinion gear, a pinion portion being disposed to cooperate with said rack portion when said pinion portion is rotated, said linear displacement device further including a crank for turning said pinion portion of said rack and pinion gear;

at least one spacer secured between said piston head and an inner shell lower end wall;

an upper seal disposed between said inner shell upper side wall and said outer shell upper side wall to prevent fluid communication therebetween;

a lower seal disposed between said piston head and said outer shell lower side wall to prevent fluid communication therebetween, said upper seal, said lower seal, said inner shell, said outer shell and said piston head cooperating to define an interior processing volume, said interior processing volume being substantially disposed away from said central axis, thereby forcing blood introduced therein to be subjected to centrifugal separation; and a shield disposed between said outer shell upper end wall first opening and the inlet/outlet coupling, said shield allowing air to be introduced into and evacuated from within a volume defined between said outer shell and said inner shell and above said upper seal.

* * * * *

UNITED STATES PATENT AND TRADEMARK OFFICE

CERTIFICATE OF CORRECTION

PATENT NO. : 6,007,472
DATED : December 28, 1999
INVENTOR(S) : Schill, David M. and Schill, Joseph G.

It is certified that error appears in the above-identified patent and that said Letters Patent is hereby corrected as shown below:

Title page, Item [54] and Column 1, line 1,
Title, change "VARIABLE VOLUME CELL SAVER BOWL" to read
-- VARIABLE VOLUME BOWL FOR COLLECTING RED BLOOD CELLS --.

Item [57], ABSTRACT,
Lines 1 and 3, delete each occurrence of the phrase "cell saver".

Column 1,
Line 11, delete the phrase "cell saver".

Column 2,
Line 66, delete the phrase "cell saver".

Column 3,
Lines 11 and 21, delete each occurrence of the phrase "cell saver".

Column 4,
Lines 39, 42, 44, 49, 57 and 59, delete each occurrence of the phrase "cell saver".

Column 9,
Lines 35, 37, 58, 60 and 66, delete each occurrence of the phrase "cell saver".

Column 10,
Lines 47, 58 and 66, delete each occurrence of the phrase "cell saver".

Column 11,
Lines 5, 17, 19 and 25, delete each occurrence of the phrase "cell saver".

Signed and Sealed this

Twentieth Day of August, 2002

*Attest:*

*Attesting Officer*

JAMES E. ROGAN
*Director of the United States Patent and Trademark Office*